US005467485A

United States Patent [19]

Casartelli

[11] Patent Number: 5,467,485

[45] Date of Patent: Nov. 21, 1995

[54] CRASH-HELMET FOR CYCLISTS AND SPORTSPEOPLE IN GENERAL

[75] Inventor: Gabriele Casartelli, Clamart, France

[73] Assignee: E.D.C. Sarl, Issy Les Moulineaux, France

[21] Appl. No.: 226,777

[22] Filed: Apr. 12, 1994

[30] Foreign Application Priority Data

Apr. 13, 1993 [EP] European Pat. Off. ..... 93105998

[51] Int. Cl.[6] ..... A42B 7/00

[52] U.S. Cl. ..... 2/421; 2/425; 24/713.1

[58] Field of Search ..... 2/410, 411, 414, 2/421, 422, 424, 425; 24/713.1, 265 R, 114.5

[56] References Cited

U.S. PATENT DOCUMENTS 4,796,309 1/1989 Nava ..... 2/425 X 5,269,025 12/1993 Broersma ..... 2/421 X 5,272,773 12/1993 Kanata ..... 2/421

5,351,341 10/1994 Broersma ..... 2/421 X

FOREIGN PATENT DOCUMENTS 77015 4/1983 European Pat. Off. ..... 2/421

*Primary Examiner*—C. D. Crowder
*Assistant Examiner*—Michael A. Neas
*Attorney, Agent, or Firm*—Collard & Roe

[57] ABSTRACT

Crash-helmet for cyclists and sportspeople includes a cap of moulded rigid material and at least two fasteners to hold the chin-strap to the cap. The fasteners are constituted by a small frame made by an isosceles triangle section, dihedron-bent at 90°, provided with suitable holders and by a strap-holding bar, suitable to be fitted into and stably held between the holder.

7 Claims, 2 Drawing Sheets

CRASH-HELMET FOR CYCLISTS AND SPORTSPEOPLE IN GENERAL

Object of this invention is a crash-helmet for cyclists and sportspeople in general, provided with a chin-strap and relevant safety fasteners of the chin-strap to the helmet cap.

As known, crash-helmets for cyclists and in general for those who practice a sport that require remarkable efforts and physical stress, besides meeting the safety requirements and being suitable for protecting the head of the user in case of falls and/or hittings against various objects or blunt bodies, must also be very light and adequately ventilated on the inside, not to become an element of discomfort and hindrance to the sports-activity during the efforts made by he user in said sports-activity.

Usually, said helmets-for cyclists, mountain-climbers, canoeists and the like are constituted by a very light protection cap of expanded material, such as polystyrene, polyurethane and the like, obtained for instance by moulding, variously shaped and provided with slits or slots for the passage and the circulation of air on the inside; the chin-strap or straps which serve to hold the helmet in position on the head of the user are fastened to the cap.

The fastening system of the strap is of great importance, as it must be such as to ensure that the strap is not torn off from the cap as a consequence of particularly intense strains, leaving the head of the user unprotected, taking into account the fact that the expanded material of which the cap is usually made has good characteristics of shock and squashing resistance, but has a very little resistance against tensile stresses, especially when these are localized stresses of the punctiform or tearing type.

To fasten the chin-strap to the cap sides, according to a known system the strap is caused to pass from the inside of the cap to the outside through a slot provided on one of the cap sides and then to pass again from the outside to the inside through a second slot parallel to the first one and provided on the other side of the cap. In this way, the strap forms a loop on the outside of the cap and does not run the risk of accidentally detaching from the helmet, but there is the drawback that the strap is not stably fastened to the cap and tends to slide in the slits, stressing their edges, which tend to bur with time and wear.

The patent application EP 0052068 (KIWI S.A.) describes a device for fastening the chin-strap to the cap, constituted by bridge or hook-shaped elements or by rivets fixed to the internal surface of same cap and so spaced from this as to create a slit which takes the end of the chin-strap; said devices have the drawback of being easily torn from the surface of the cap following wing particularly heavy strains, and besides their realization is complicate and expensive, especially as concerns their assembly.

The U.S. Pat. No. 5,005,220 (BRANCALE S.r.l.) describes a fastening device of the chin-strap to the cap constituted by a rectangular buckle to which the strap end is fixed; the buckle carrying the strap is then caused to pass from the inside of the cap to the outside through a slot of suitable width, and is then housed in a recess or impression provided on the external surface of the cap. Such device, thanks to the large bearing surface, eliminates in practice the risk of the strap being torn off from the cap due to strong strains or following a breaking or scaling off of the expanded material, but has the drawback that the buckle carrying the strap may detach, following particular strains, from the helmet, sliding towards the inside of the cap through the same slot which had served to let it pass from inside to the outside.

Object of this invention is the realization of a crash-helmet for cyclists, mountain-climbers and sportspeople in general, provided with a chin-strap, in which helmet the strap is stably fastened to the cap of expanded material and does not run the risk of being torn off accidentally following particular or heavy strains, leaving the head of the user unprotected on the very moment of greatest need, i.e. in case of accidents or the like.

A further object of this invention is the realization of a crash-helmet for cyclists provided with a device for fastening the chin-strap to the cap, said device being of easy and simple realization and assembly.

These and still other objects and the relevant advantages which will be more clearly disclosed by the following detailed description are obtained by a crash-helmet for cyclists, mountain-climbers and sportspeople in general, which helmet, according to this invention, comprises:

- a protection cap of rigid expanded material such as polystyrene, opportunely shaped and provided with cavities, slots and various openings suitable to ensure an adequate ventilation within the cap, as well as slits and slots suitable to permit the passage of chin-straps;
- at least a couple of elements for fastening chin-straps on the two external sides of said cap, constituted by a small frame provided with a couple of holding and engagement means placed in opposite position with respect to one another along the edges of said frame, and by a small strap-holding bar suitable to be fitted and stably held between said holding and engagement means;
- at least a couple of chin-straps provided at one end with a loop or eyelet, suitable to be engaged on said strap-holding bar.

More in detail, said holding and engagement means are constituted by cavities or recesses provided along the edges of the frame, which cavities may be circular or semi-circular, square or the like, or even cylindrical and placed in a simmetrically opposite position with respect to one another, suitable to house and hold stably fitted in the opposite ends of the strap-holder bar, on which the loop or eyelet provided at the end of the chin-strap has been threaded.

The frame may have a square, rectangular, circular form or the like, or any form whatever, depending on the form and conformation of the cap surface and the position where the fastener must be placed.

A fastening element has proved particularly advantageous according to this invention, said element being constituted by a frame having substantially the form of an isosceles triangle dihedron-bent at 90° along its height, wherein the holding and engagement means are placed in correspondence of the vertex and the center of the base of said isosceles triangle respectively, so that the strap-holding bar carrying the eyelet of the chin-strap is placed in correspondence to and along the edge of the dihedron. A fastener of such conformation may be advantageously placed in a housing provided for instance along one of the 90° cavities provided on the side external surface of the cap, such cavity also having the function of conveying and distributing the air flow for an adequate ventilation of the helmet inside.

According to this invention, the end of the chin-strap carrying the eyelet, opposite to the end carrying the connection buckle, is caused to pass from inside the cap to the outside through a slit especially provided on the external surface of the helmet; in this case, the width of the slit must be barely sufficient to permit the passage of the strap eyelet, an therefore equivalent to twice the thickness of the same strap; the strap is then caused to pass through the frame, letting the eyelet protrude above the same. Then the bar is inserted in the eyelet and, operating opportunely, the bar carrying the eyelet is caused to fit in the engagement means provided in the frame, exploiting to this purpose the elasticity of the frame and of the engagement means, the latter being usually made of plastic material rigid but always elastically yielding as much as is necessary to introduce or cause the ends of the bar to pass into the relevant cavities or recesses. In this way, the bar and the frame form an integral whole constituting the fastening element, which is placed in its turn on the external side of the cap by fitting in or the like in a special housing or impression; the latter may be realized, for instance, in correspondence of one of the cavities or channels provided on the cap surface for opportunely conveying the air towards slots or aeration holes. Obviously, the fastening element according to this invention prevents the chin-strap from unthreading in any way whatever or from being torn off from the cap, ensuring in this way the utmost utilization safety for the user, together with a great simplicity of realization and assembly.

The functional and structural characteristics of the helmet according to this invention shall result more clearly from the following detailed description of some preferred but not exclusive embodiments, wherein reference is made to the attached drawings, which are to be construed as mere indications, wherein:

FIG. 6 shows the rear side of the cap of a crash-helmet for cyclists carrying an impression or housing for the fastening element; while

Figure 1:
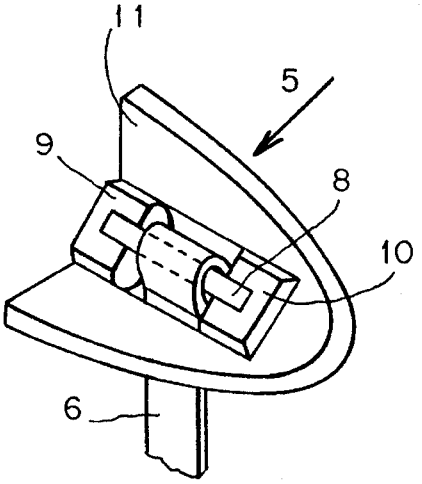
FIG. 1 shows a fastening element according to this invention, of the type with frame having a triangular profile, bent at 90°.
Figure 2:
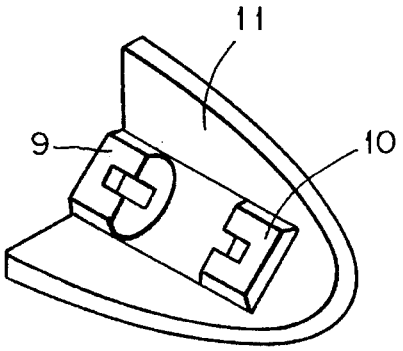
FIG. 2 shows the frame of the fastening element separated from the strap-holding bar.
Figure 3:
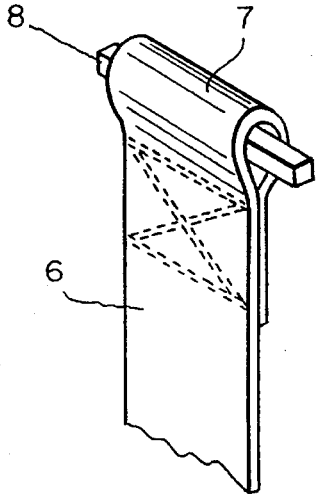
FIG. 3 shows a strap-holding bar threaded in the eyelet provided at the end of the chin-strap.
Figure 4:
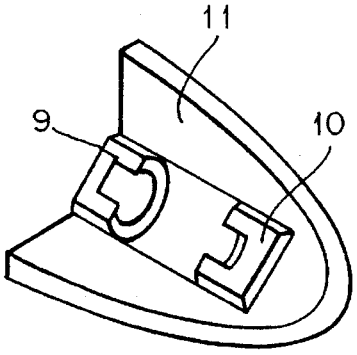
FIG. 4 and FIG. 5 show frames provided with engagement and holding means of different type.
Figure 5:
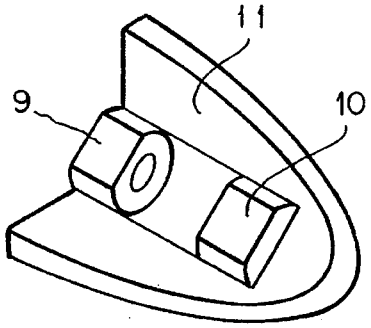
Figure 6:
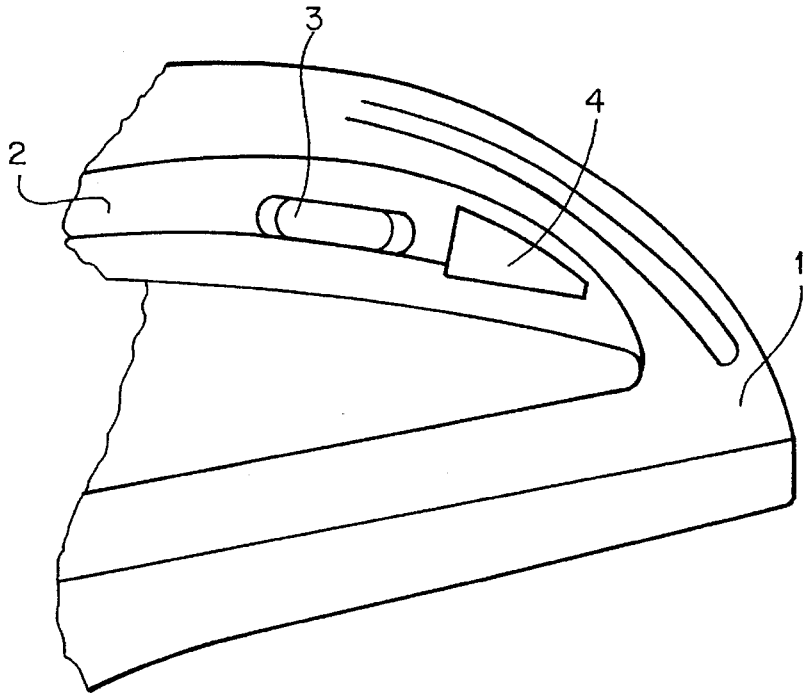
Figure 7:
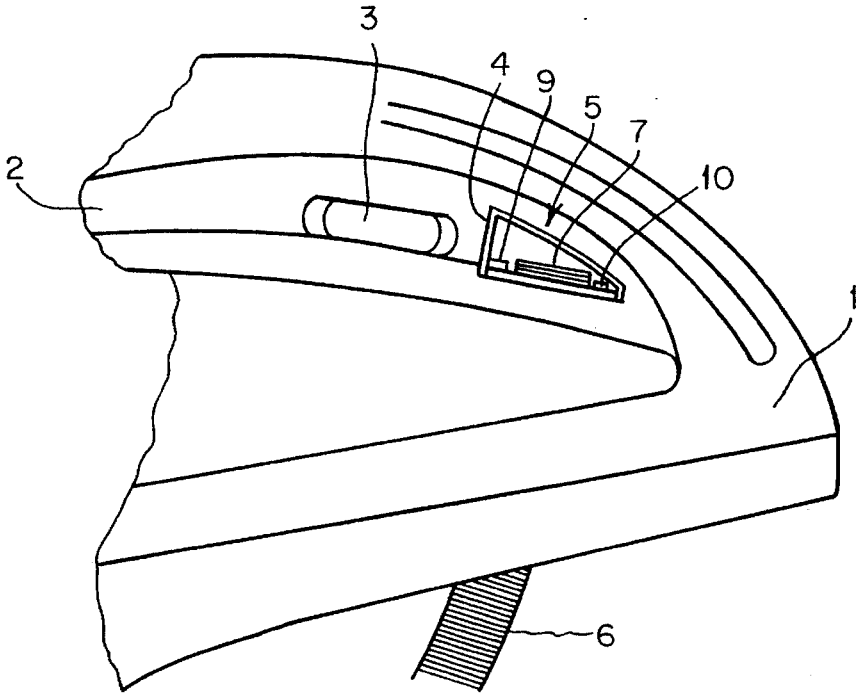
FIG. 7 shows the same part of cap of FIG. 6, with the fastening element housed in the special impression.

With reference to such figures, on the external surface of cap 1 of the crash-helmet according to this invention, in correspondence of the cavity or channel 2 realized to convey adequately the ventilation air towards slot 3, the impression 4 is provided, suitable to house the fastening element 5 of chin-strap 6, which strap passes into the inside of the cap through a slot provided in correspondence of impression 4—the slot being not visible in the figure. Strap 6 is provided at one of its ends with eyelet or loop 7 in which the strap-holding bar 8 inserts. As known, the opposite end of the chin-strap is engaged by the buckle which serves to buckle the strap under the user's chin. Bar 8, of parallelepipedal form on FIG. 1 and 3, fits, with both its opposite ends, into the engagement and holding means 9 and 10 which are provided in frame 11. The frame 11 illustrated in the figures is of the type having substantially the profile of an isosceles triangle with rounded vertexes, bent at 90° along its height, so as to form a dihedron suitable to be housed in a point of cavity 2, the latter forming also a 90° angle on the external surface of the cap. On FIG. 4, the holding means of the frame are constituted by semi-circular cavities, while on FIG. 5 the same means are constituted by cylindrical cavities, particularly suitable to house the ends also cylindrical of the strap-holding bar.

Obviously, in the practical realization structurally and functionally equivalent changes and variants may be introduced in the invention as described hereinabove, always falling within the protection scope of this invention.

I claim:

1. Crash helmet for cyclists and sportspeople comprising a protection cap of rigid expanded material opportunely shaped and provided with means defining openings suitable to ensure an adequate ventilation within said cap, and means defining slots suitable to permit the passage of chin-straps;

at least two elements for fastening chin-straps on two external sides of said cap, constituted by a small frame provided with two holding and engagement means placed in opposite position with respect to one another along the edges of said frame and by a strap-holding bar suitable to fit in and be stably held between said holding and engagement means;

at least two chin-straps provided on one end with an eyelet loop suitable to be engaged on said strap-holding bar;

said frame has basically the profile of an isosceles triangle, dihedron-bent at 90° along its height to form an edge, said holding and engagement means being placed in correspondence of the vertex and the centre of the basis of said isosceles triangle respectively, so that said strap-holding bar, fitted in said holding means is placed in correspondence of the edge of the dihedron.

2. Crash-helmet according to claim 1, wherein the fastening elements each comprising said frame having the profile of an isosceles triangle are placed in a housing provided along a cavity on a side external surface of the cap of said crash-helmet.

3. Crash helmet for cyclists and sportspeople, comprising a protection cap of rigid expanded material opportunely shaped and provided with means defining openings, suitable to ensure an adequate ventilation within said cap, and means defining slots suitable to permit the passage of chin-straps;

at least two elements for fastening chin-straps placed on two opposite external sides of said cap, each element being constituted by:

a strap holding bar, and a small frame provided with two holding and engagement means constituted by cavities placed in symmetrically opposite position with respect to one another along the edge of said frame, said holding means being configured to stably and removably hold said strap-holding bar by respectively engaging the two opposite ends of said strap-holding bar; and at least two chin-straps each provided on one end with an eyelet loop engaged on a section of said strap-holding bar not engaged by said holding means.

4. Crash-helmet according to claim 3, wherein said cavities provided along the edge of said frame have a form selected from the group consisting of circular, semi-circular, square, rectangular, and cylindrical.

5. Crash-helmet according to claim 3, wherein said small frame has a form selected from the group consisting of square, rectangular, polygonal, and circular.

6. Crash-helmet according to claim 3, wherein said frame has basically the profile of an isosceles triangle, dihedron-bent at 90° along its height to form an edge, said holding and engagement means being placed in correspondence of the vertex and the centre of the basis of said isosceles triangle respectively, so that said strap-holding bar, fitted in said holding means is placed in correspondence of the edge of the dihedron.

7. Crash-helmet according to claim 6, wherein the fastening elements each comprising said frame having the profile of an isosceles triangle are placed in an impression provided along a cavity of the side external surface of the cap of said crash-helmet.

* * * * *